US007051404B2

(12) United States Patent
Roy

(10) Patent No.: US 7,051,404 B2
(45) Date of Patent: May 30, 2006

(54) SELF-LOCKING HINGE

(75) Inventor: Armand E. Roy, Attleboro, MA (US)

(73) Assignee: Craft, Inc., South Attleboro, MA (US)

( * ) Notice: Subject to any disclaimer, the term of this patent is extended or adjusted under 35 U.S.C. 154(b) by 0 days.

(21) Appl. No.: 10/849,588

(22) Filed: May 20, 2004

(65) Prior Publication Data

US 2005/0034275 A1 Feb. 17, 2005

Related U.S. Application Data

(60) Provisional application No. 60/494,243, filed on Aug. 11, 2003.

(51) Int. Cl.
*E05D 1/00* (2006.01)

(52) U.S. Cl. ..... 16/355; 16/377; 16/337; 16/382

(58) Field of Classification Search ..... 16/355, 16/337, 342–344, 377, 332, 254, 382
See application file for complete search history.

(56) References Cited

U.S. PATENT DOCUMENTS

| | | | | |
|---|---|---|---|---|
| 0,880,757 | A | 3/1908 | Rugg | 16/178 |
| 0,972,090 | A | 10/1910 | Ault | 16/270 |
| 1,009,500 | A | 11/1911 | Glathart | 16/270 |
| 1,047,148 | A | 12/1912 | Barcus | 16/270 |
| 1,286,694 | A | 12/1918 | MacDonald | 16/270 |
| 1,433,095 | A | 10/1922 | Peary | 16/270 |
| 1,566,236 | A | 12/1925 | Skurdal | 16/178 |
| 1,569,619 | A | 1/1926 | Cranzler | 16/376 |
| 1,593,929 | A | 7/1926 | Carrier | 16/374 |
| 1,863,323 | A | 6/1932 | Berne | 16/256 |
| 1,893,592 | A | 1/1933 | Newman | 16/178 |
| 2,211,581 | A | 8/1940 | Ross | 16/364 |
| 2,571,633 | A | 10/1951 | Vogel | 16/388 |
| 2,811,741 | A | 11/1957 | Miller et al. | 16/376 |
| 2,825,917 | A | 3/1958 | Scinta | 15/250.32 |
| 2,857,618 | A | 10/1958 | Jordan | 16/191 |
| 3,080,603 | A | 3/1963 | Spiselman | 16/191 |
| 3,131,659 | A | 5/1964 | Idomoto | 112/260 |
| 3,181,197 | A | 5/1965 | Sperber | 16/274 |
| 3,994,045 | A | 11/1976 | Roy | 16/178 |
| 4,050,117 | A | 9/1977 | Roy | 16/178 |
| 4,063,330 | A | 12/1977 | Triplette | 16/142 |
| 4,199,126 | A | 4/1980 | Komendowski | 248/463 |
| 4,349,942 | A | 9/1982 | Roy | 16/376 |

(Continued)

*Primary Examiner*—Chuck Y. Mah
*Assistant Examiner*—Michael J. Kyle
(74) *Attorney, Agent, or Firm*—Barlow, Josephs & Holmes, Ltd.

(57) ABSTRACT

The self-locking hinge (24) includes a first plate (28) hingedly connected to a second plate (30). Fasteners (24) are provided on the plates to secure them to a member, such as a easel strut hinge (24) of picture frame back (20). A locking structure is connected to the first plate (28) and the second plate (30) for maintaining the second plate (30) in the substantially open position relative to the first plate (28). The locking hinge (24) includes a protrusion (36) on the first plate (28) that removably engages with a free edge (34) of the second plate (30). The hinge (24) also includes a structure for maintaining the second plate (30) in rotating arrangement with the first plate (28) when the plates (28, 30) are hingedly secured to one another in a rolled pinless fashion. Locking lugs (40) are used to maintained the second plate (30) rolled about the first plate (28).

6 Claims, 14 Drawing Sheets

U.S. PATENT DOCUMENTS

| | | | | |
|---|---|---|---|---|
| 4,407,044 | A | 10/1983 | Iseki | 16/237 |
| 4,734,955 | A * | 4/1988 | Connor | 16/332 |
| 4,850,082 | A | 7/1989 | Yi | 16/341 |
| 4,979,266 | A | 12/1990 | Roy | 16/376 |
| 5,287,596 | A * | 2/1994 | Chen et al. | 16/331 |
| 5,361,455 | A | 11/1994 | Kiefer | 16/235 |
| 5,455,989 | A * | 10/1995 | Roy | 16/376 |
| 6,513,197 | B1 * | 2/2003 | Rude et al. | 16/342 |
| 6,557,810 | B1 * | 5/2003 | Roy | 248/456 |
| 6,588,062 | B1 * | 7/2003 | Novin et al. | 16/342 |
| 6,772,905 | B1 * | 8/2004 | Cheng | 220/840 |

* cited by examiner

SELF-LOCKING HINGE

CROSS-REFERENCE TO RELATED APPLICATION

This application claims the benefit of U.S. Provisional Patent Application Ser. No. 60/494,243, filed Aug. 11, 2003.

BACKGROUND OF THE INVENTION

The present invention relates generally to hardware used to rotatably connect two members together. More specifically, the present invention relates to hinge hardware used to rotatably attach a strut to a picture frame. In addition, the present invention relates to a self-locking hinge assembly that is used to connect a picture frame strut to a picture frame back.

It is well known in the art to use a hinge to rotatably attach one member to another, such as a door to a door frame or a picture frame strut to a picture frame back. Typically, the hinge includes two plates which are rotatably connected to one another by a pin. The plates are respectively connected to the two members by some type of fastener, such as threaded fastener, nail or rivet. In the environment of picture frames, rosette fasteners are commonly employed for this purpose.

In the industry of hinges and the structures that use them, there is a need to maintain the hinge in a open condition to, thereby, maintain the two members apart from one another. This general structure is the subject of the present invention. By way of example and ease of illustration, this environment will be described in connection with a picture frame environment, as will the description of the present invention. It should be understood that the present invention relates to any environment that employs a hinge construction.

Turning now to the picture frame industry, by way of example, a typical picture frame assembly includes a back member, which is usually made of cardboard, which fits into a rear seat in a frame molding which can be made of wood, plastic, metal, or the like. A number of turn buttons are commonly attached to the rear side of the molding and pivot into place over the periphery of the back member to secure it in place. A piece of glass, clear plastic, or the like, is positioned between the back member and the molding. A picture, to be displayed, is positioned between the back member and glass.

A picture frame may be mounted for display in several different ways. For example, a hanger or wire may be affixed to the rear side of the frame molding for hanging the frame on a wall for display. Also, a strut is typically employed when the picture frame is to be displayed on a surface, such as a desk or shelf. This strut is hingedly connected to the picture frame back. The strut is commonly shipped in with its strut member in a collapsed condition where it rests flush against the rear side of the picture frame back and frame molding. For the display of a picture frame, the strut member is opened via the hinge and the picture frame is then set on the surface with the bottom of the frame molding and free end of the strut, which is typically flat, in contact with the support surface. Thus, the picture frame is displayed in and easel-like fashion for viewing.

It is well known in the picture frame industry that it is desirable to maintain the easel hinge in either the open or closed position. This is particularly useful when moving the picture frame. For example, when picture frame is first used, the desired picture is inserted into the frame, as is well known, and strut is opened and the picture is placed in its desired position on a support surface, such as on top of a shelf. If the picture frame is desired to be moved, it is common for the strut to freely rotate making it difficult to handle and place on a mantel, particularly if it is crowded with other picture frames and there is little room to use two hands, with one hand holding the frame and the other holding the strut, to place the frame and prop it up in the desired location. Further, there is a desire to keep the strut flush against the back of the frame during transport of the frame. In general, there is a desire to control the rotating movement of the strut relative to the back of the picture frame. These same concerns exist in any hingedly connected member environment but they are of particular concern in the picture frame environment.

There have been many attempts in the prior art to address the foregoing concerns of a strut member on a picture frame back. For example, prior art picture frame assemblies have included struts that have very tight hinge connections where it is made more difficult to rotate the strut relative to the picture frame back. For example, a very tight hinge pin or tightly crimped pinless hinge may be employed. These prior art constructions prevent the strut from easily rotating but, over time, these hinge become loose resulting in a free rotating strut.

Also, these prior art constructions cannot control how much the hinge rotates to indicate a proper open or closed position. The hinge can be opened or closed partially resulting in inconsistent strut angles from frame to frame. Thus, there is a need to provide a hinge that two clear positions, that is, an open position and a closed position and no interim partial opened positions therebetween.

In the prior art, there have been attempts to control the rotating of the easel hinge in a picture frame. For example, a fixed length of ribbon, string or wire have been attached between the strut and the picture frame back to control the open position of the strut. The fixed length of material permits the strut to only be opened a predetermined amount thereby setting the open position of the strut. However, such a structure only sets the maximum open position of the strut and does not control the movement of the strut between an open position and the closed position. Moreover, in this prior art example, the strut cannot be maintained in a closed position against the picture frame back.

In view of the foregoing, there is a demand for a hinge that can be locked into a definitively locked open position without the use of tools. There is also a demand for a hinge that can be locked into a definitively locked closed position without the use of tools. There is a further demand for such a hinge to be easily movable from a locked open position to a locked closed position and vice versa. There is a demand for a self-locking hinge that is relatively easy to manufacture at low cost to meet high production requirements.

SUMMARY OF THE INVENTION

The present invention preserves the advantages of prior art hinge constructions and related hardware including picture frame easel hinges. In addition, it provides new advantages not found in currently available hinges and overcomes many disadvantages of such currently available hinges and related assemblies.

The invention is generally directed to a new and novel hinge that has particular application in the connection of picture frame members together, namely, a strut to a picture frame back.

The picture frame joint of the present invention provides a self-locking hinge for hingedly connecting a first member to a second member. A first plate is provided having length, a width, a top edge and a top surface. Fastening structure is connected to the first plate for affixing the first plate to a first member. A second plate is provided having a length, a width, a top edge, a top surface and a free edge. The second plate is rotatably connected to the first plate about a pivot axis, from a substantially closed position to a substantially open position relative to the first plate. A second fastening structure is connected to the second plate for affixing the second to a second member. A locking structure is connected to the first plate and the second plate for maintaining the second plate in a substantially open position relative to the first plate. The locking structure also maintains the second plate in a substantially open position relative to the first plate.

It is therefore an object of the present invention to provide a hinge that can be easily locked into a number of different positions, such as an open position and a closed position. It is an object of the invention to provide a self-locking hinge that can be removably secured into an open position and a closed position. A further object of the present invention is to provide a self-locking hinge that can be easily moved from a fixed open position to a fixed closed position. It is also an object of the present invention to provide a self-locking hinge that can be easily moved from a fixed closed position to a fixed open position. Another object of the present invention is to provide a self-locking hinge that is easy to manufacture at high volumes for mass production at low cost per unit.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1A:
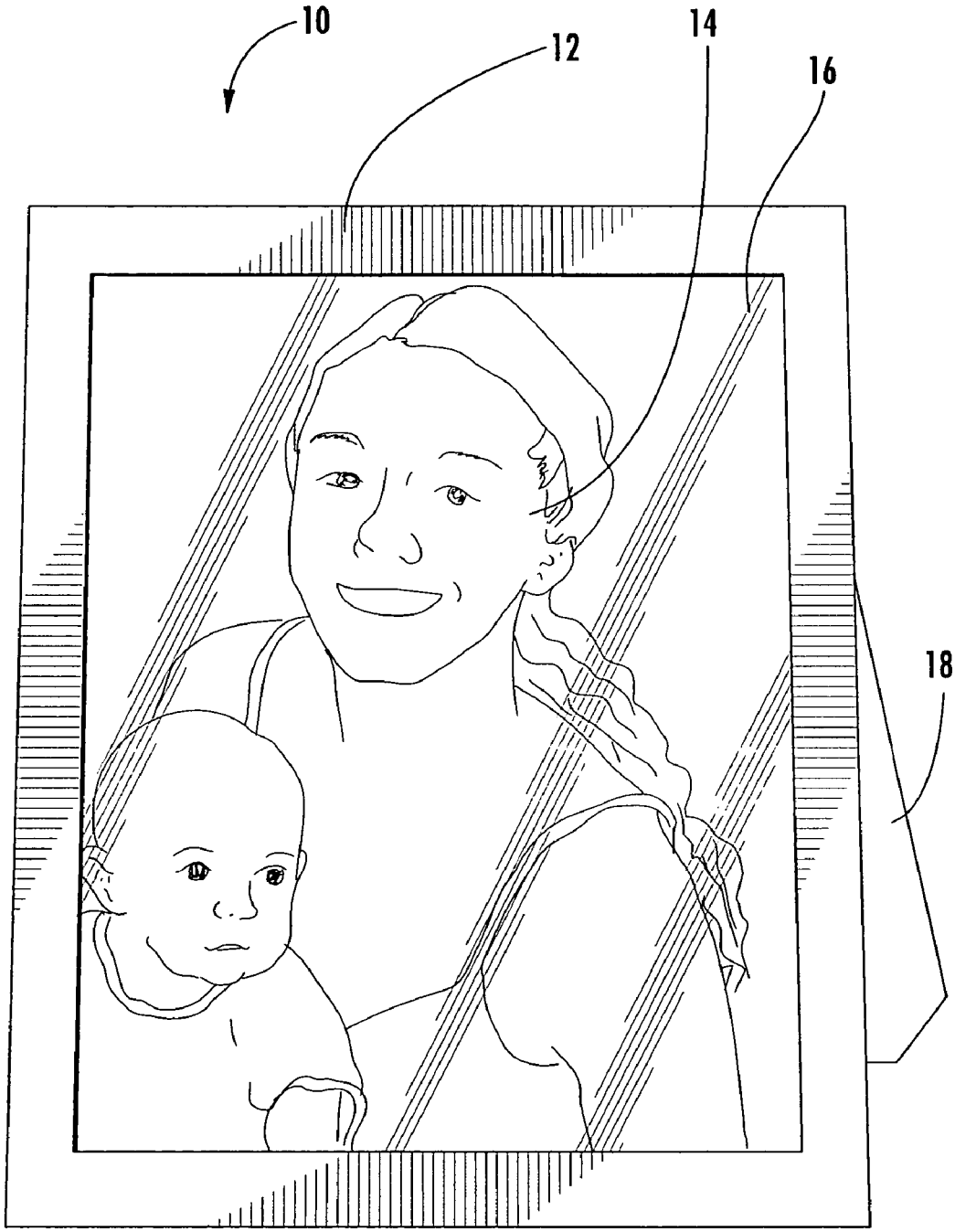
FIG. 1A is a perspective view of the front of a picture frame being held in an upright position by a picture frame strut.

Referring first to FIG. 1A, a front perspective view of a picture frame assembly 10 is shown. A outer frame molding 12 is provided with a photograph or artwork 14 residing behind a transparent plate 16, such as glass or Plexiglas. The frame molding 12 can be made of wood, ceramic, and the like. A strut 18 is employed to prop up the frame molding 12 into a substantially upright position. Picture frame struts 18 are also typically made of cardboard but could be made of other materials, such as wood. This general structure is well known in the art.

Figure 1B:
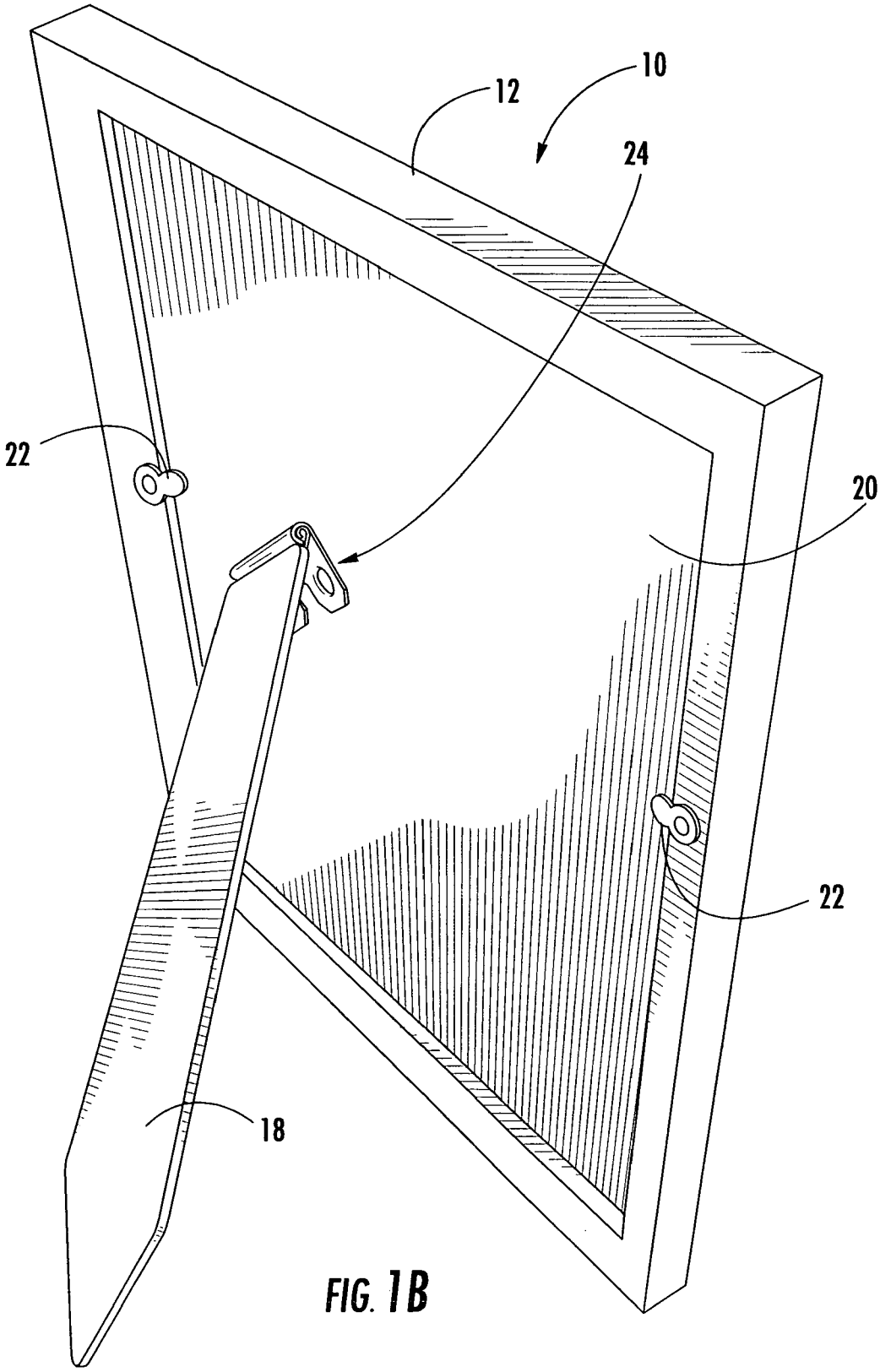
FIG. 1B is a perspective view of the back of a picture frame with a strut hingedly connected thereto by the hinge of the present invention with the strut in an opened position.

FIG. 1B illustrates a rear perspective view of the picture frame assembly 10 that is generally known in the art. The photograph 14 and transparent plate 16 (shown in FIG. 1A) is sandwiched between a picture frame back 20, preferably made of cardboard, and the frame molding 12 as is well known in the art. Turn buttons 22 are provided to maintain the picture frame back 20 within the frame molding 12 and the photograph 14 sandwiched therebetween. The picture frame strut 18 is hingedly connected to a picture frame back 20 by an easel hinge 24. Typically, the hinge 24 and turn buttons 22 are preferably made of metal but could be made of other materials as well.

Figure 1C:
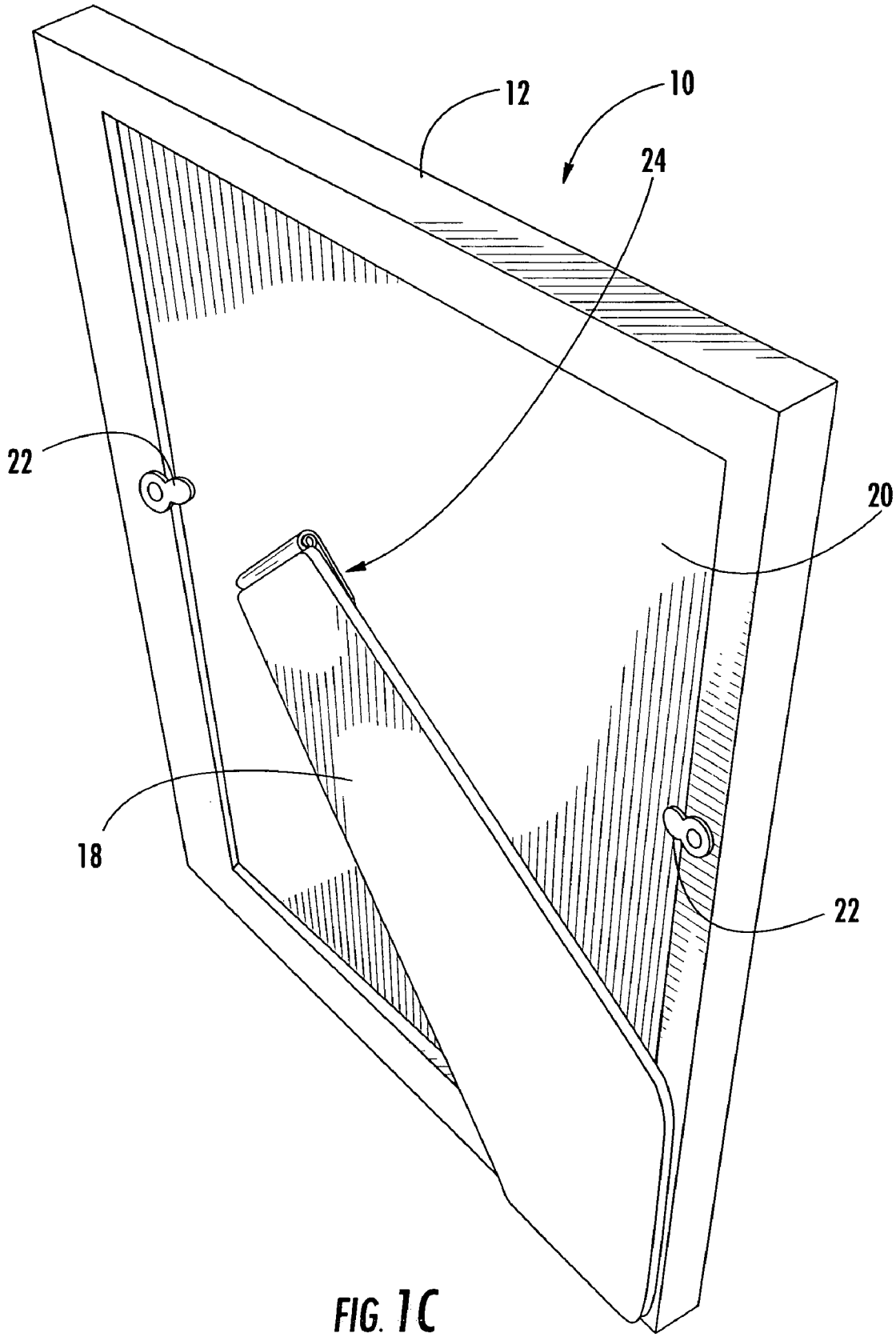
FIG. 1C is a perspective view of the back of a picture frame with a strut hingedly connected thereto by the hinge of the present invention with the strut in a closed position.

Many different types of easel hinges may be employed. Hinge 24 is of a unique construction in accordance with the present invention. However, FIGS. 1A, 1B and 1C illustrate a picture frame assembly 10 that employs the self-locking hinge 24 of the present invention instead of a prior art easel hinge. FIG. 1B shows the strut 18 in a locked opened position while FIG. 1C shows the strut 18 in a locked closed position against the back 20 of the picture frame assembly 10. As will be described in detail below, the hinge 24 of the present invention includes a unique locking structure that can removably secure the picture frame strut 18 in an open or closed position, as desired.

Figure 2:
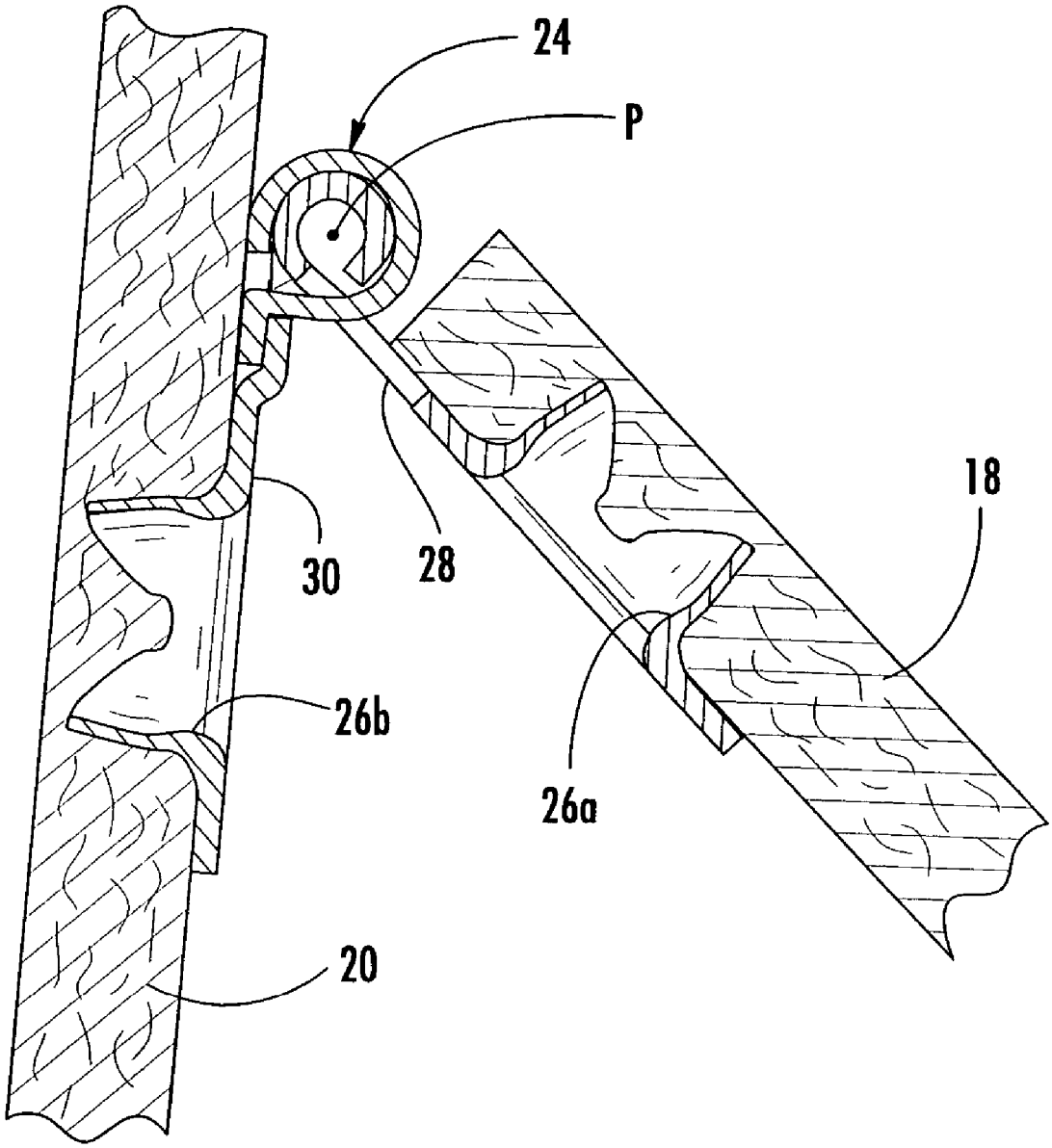
FIG. 2 cross-sectional view through the line 12—12 of FIG. 7 with the hinge open and attached to a strut and picture frame back as shown in FIG. 1B.

FIG. 2 illustrates a cross-sectional view of the hinge 24 of the present invention hingedly connecting a strut 18 to a picture frame back 20. The hinge 24 is preferably connected to the back 18 and the strut 18 by rosette type fasteners 26*a* and 26*b* which greatly facilitates connection of the preferably metal hinge 24 to the cardboard strut 18 and picture frame back 20. If other materials are used, different fastening structures can be used and still be within the scope of the present invention.

The picture frame strut 18 is connected to a first plate 28 and the picture frame back 20 is connected to a second plate 30. The first plate 28 and the second plate 30 are rotatably connected to one another along a pivot axis "P". FIG. 2 shows the pivot connection to be a pinless type connection to permit rotation of the first plate 28 and the second plate 30 relative to one another. This pinless arrangement is one of many different types of pivot connections that can employ the present invention. Such as pinless easel hinge is described in U.S. Pat. No. 3,994,045. Alternatively, a pinned pivot arrangement, similar to a door hinge, can also be used, if desired.

In the prior art as discussed above, this pivot arrangement freely rotates about the pivot axis P so that the picture frame strut 18 freely moves. The present invention provides a structure to control such rotating movement of the strut 18 relative to the picture frame back 20, namely, the movement of the first plate 28 relative to the second plate 30 in a hinge 24.

Figure 3:
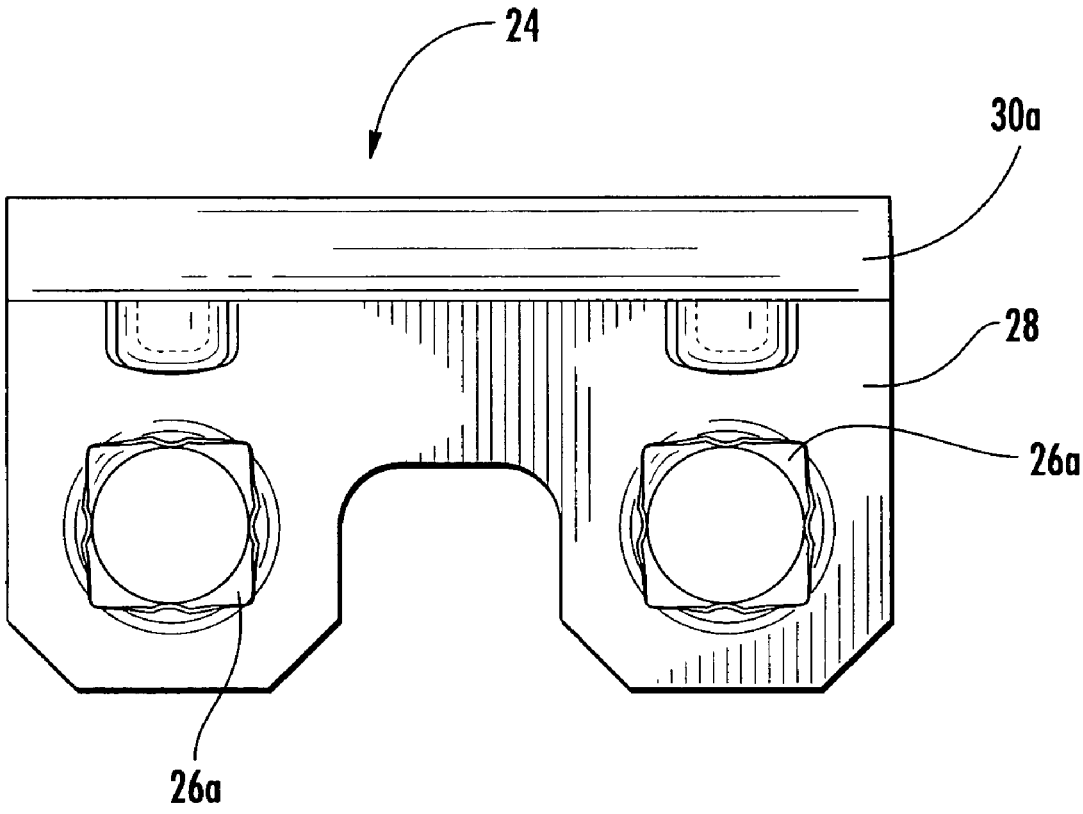
FIG. 3 is a top view of the hinge of the present invention in a closed condition.

FIGS. 3–12 show, in detail, the self-locking hinge 24 of the present invention. FIG. 3 shows a top view of the hinge 24 of the present invention where the first plate 28 can be seen with a number of fasteners, namely rosette fasteners 26*a* and 26*b*, to facilitate connection to the picture frame strut 18.

Figure 5:
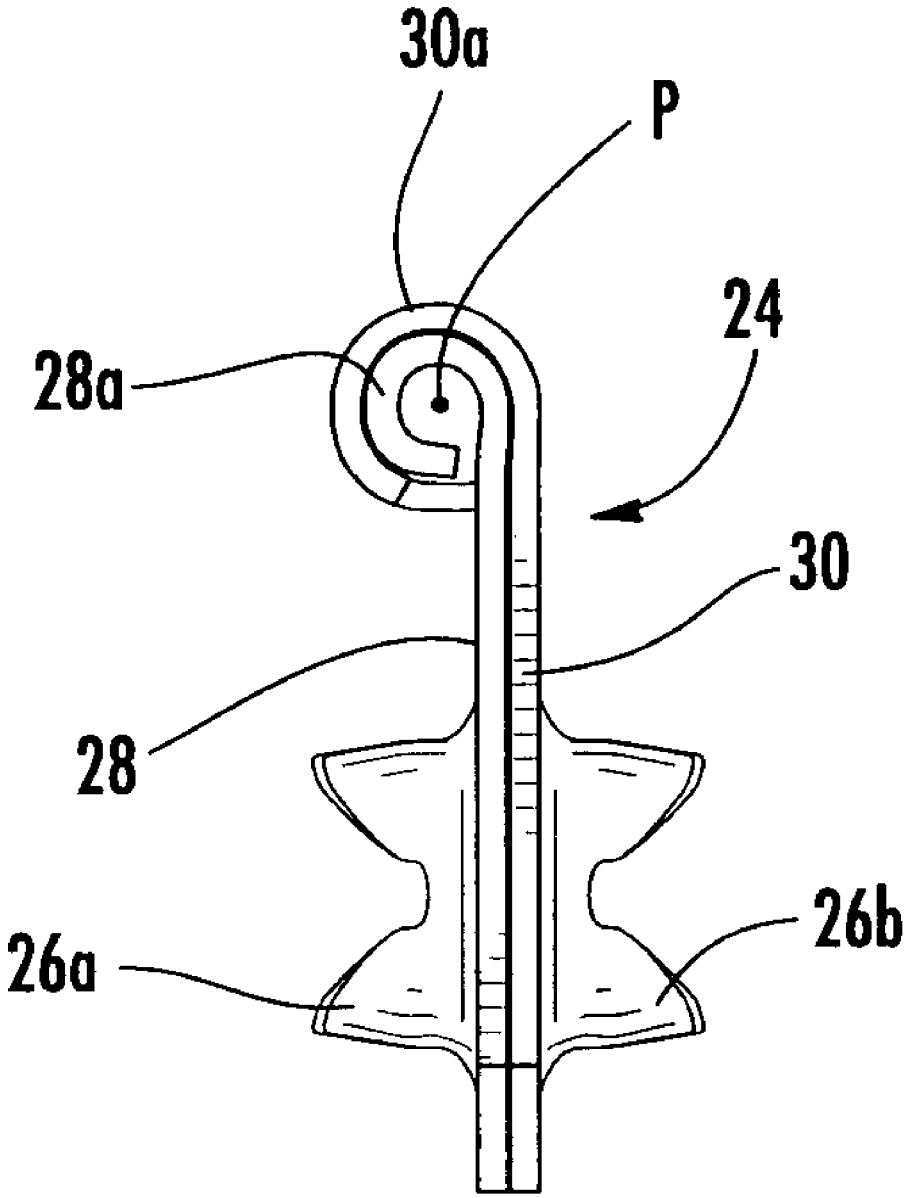
FIG. 5 is a side elevational view of the hinge of FIG. 3 in a closed condition.

Referring to both FIGS. 3 and 5, the rotating connection between the first plate 28 and the second plate 30 is shown in detail. The top edge 28*a* of the first plate 28 is rolled along with the top edge 30*a* of the second plate 30 to form a pivot structure and pivot axis, as can be best seen in FIG. 5. FIG. 5, a right side elevational view of the hinge of FIG. 3, also illustrates a number of fasteners 26*b*, preferably rosette fasteners, on the second plate 30 to facilitate connection to the picture frame back 20. This pinless pivot connection about P is preferred to simplified and speed up manufacturing of the hinge 24 for mass production. However, other interconnections, such as a pinned connection, may also be used.

Figure 4:
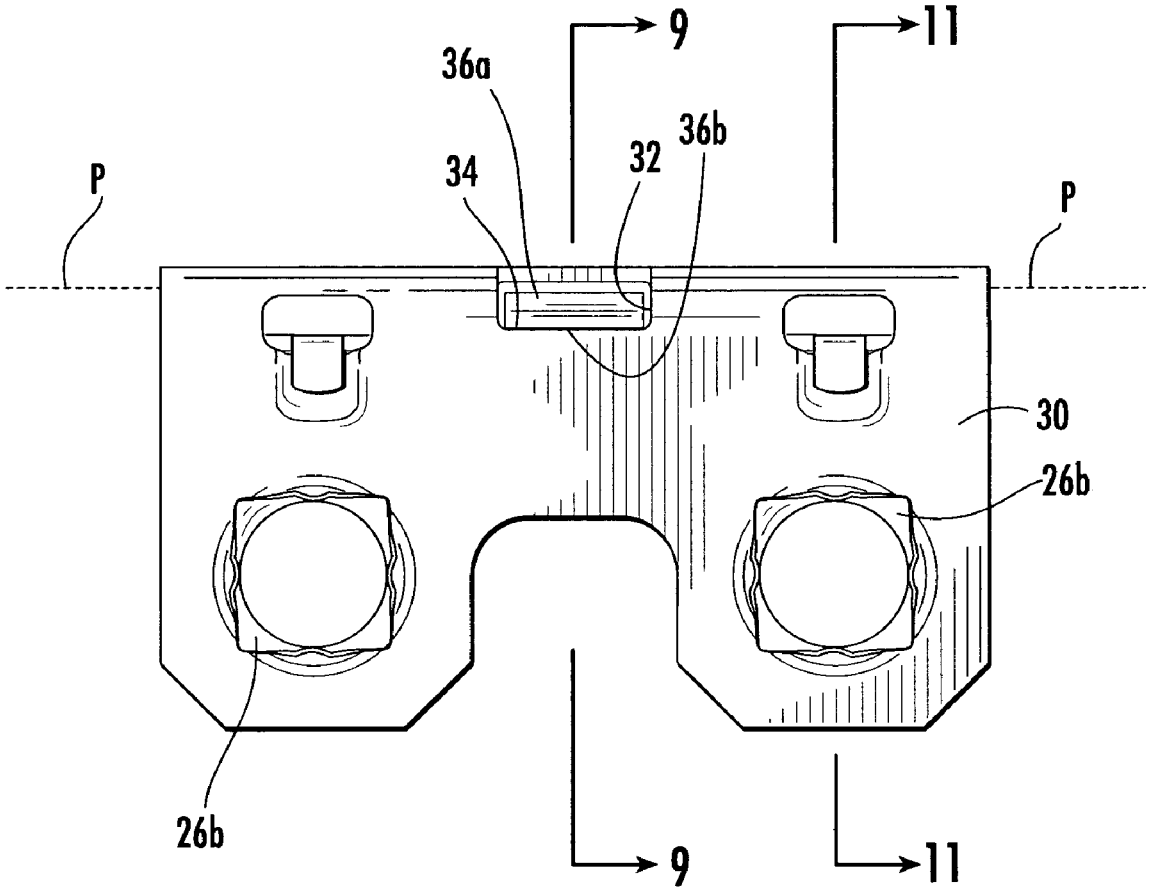
FIG. 4 is a bottom view of the hinge of FIG. 3 in a closed condition.

Turning now to FIG. 4, a bottom view of the hinge 24 of the present invention is shown. The second plate 30 is shown to include its rosette fasteners 26*b* for connection of the hinge 24 to a picture frame back 20. A window aperture 32 is provided through the second plate 30 with a locking edge 34. The window aperture 32 is preferably located near the pivot axis P for ease of manufacturing but may be located any where on the second plate 30. A locking protrusion 36 emanates upwardly from the top edge 28*a* of the first plate 28, as best seen in FIGS. 9 and 10, so it may removably reside in the window aperture 32 of the second plate 30.

Figure 9:
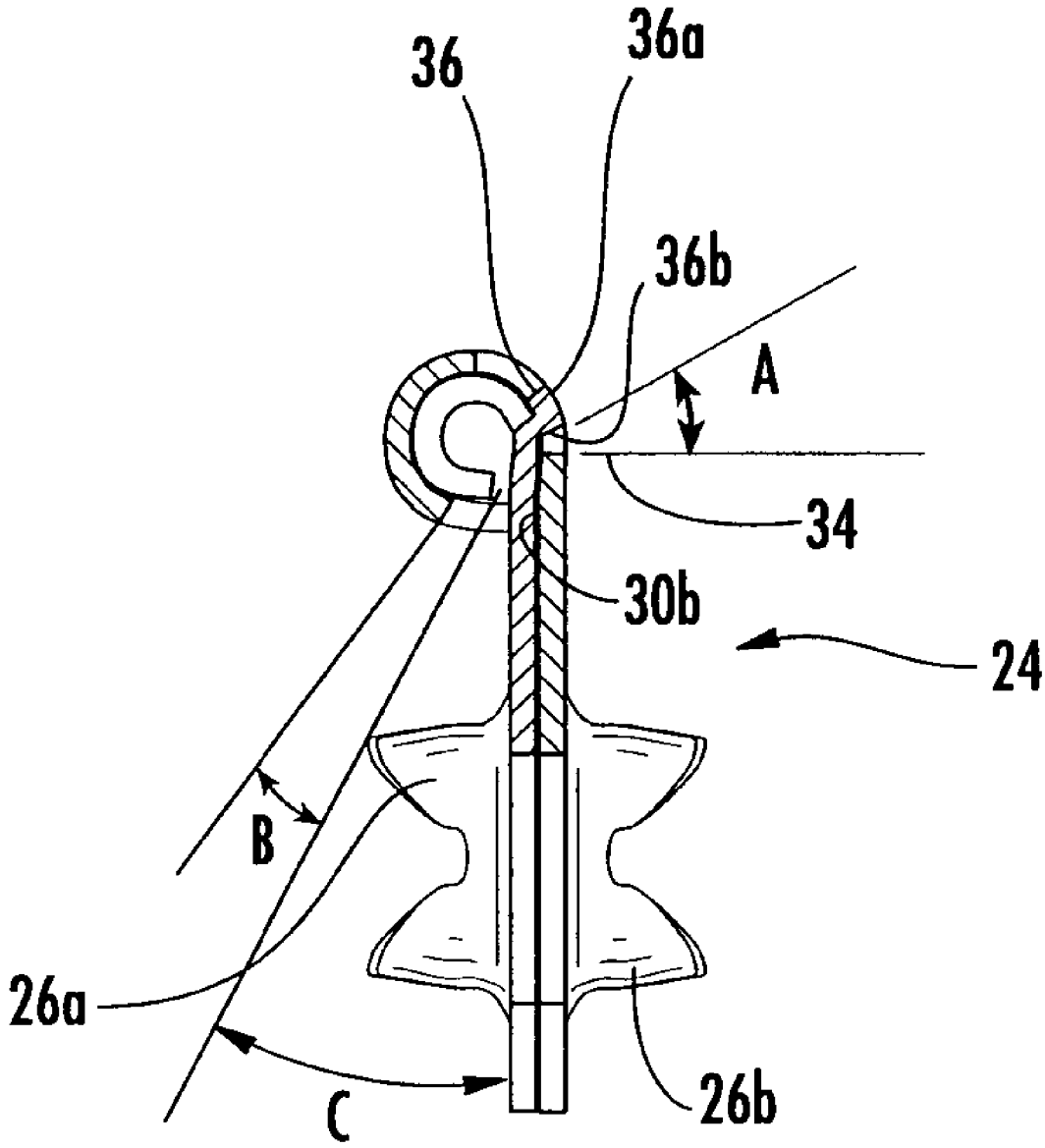
FIG. 9 is a cross-sectional view through the line 9—9 of FIG. 4.
Figure 10:
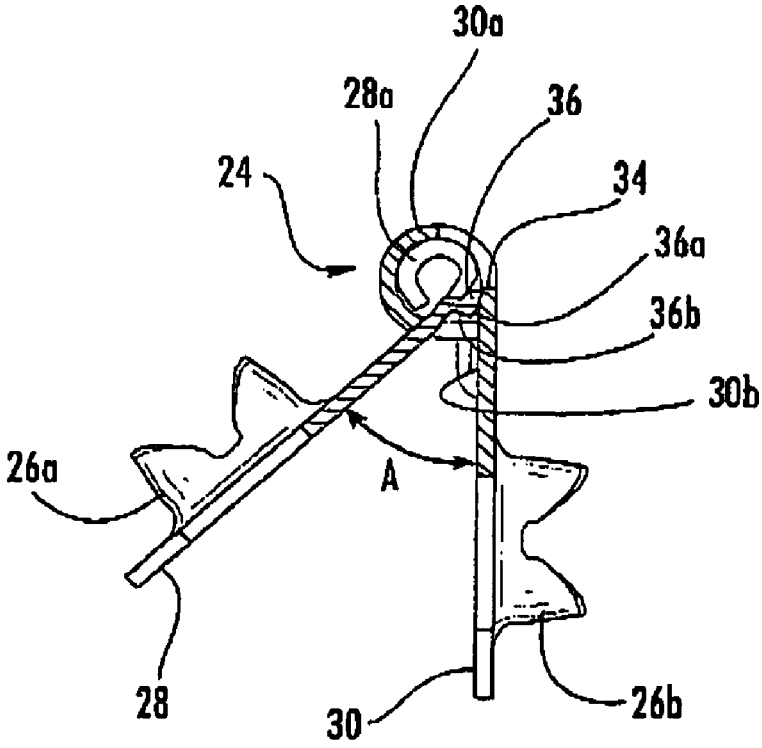
FIG. 10 is a cross-sectional view through the line 10—10 of FIG. 7.

FIGS. 4 and 9 show the positioning of the locking protrusion 36 within the window aperture 32 when the hinge 24 is in a closed condition. The protrusion 36 includes a leading contact surface 36*a* and a side contact surface 36*b*. Also, the window aperture 32 in the second plate 30 defines an edge contact surface 34 and a side plate surface 30*b*. In this closed condition, the protrusion 36 residing within the window aperture 32 controls the rotation of the first plate 28 relative to the second plate 30 by the angle defined as "A". Thus, is possible to lift a strut 18 attached to the first plate 28 slightly to get a finger thereunder to assist in pulling it to an open condition, as will be described below. The first plate 28, with strut 18 attached thereto, can be opened to its open condition to an angle represented by angle "B" which is smaller than angle "A".

The protrusion 36 and window aperture 32 arrangement thereby prevents the first plate 28 from being opened all the way to its fully open condition to angle "B". Thus, FIGS. 4 and 9 illustrate the locking of the hinge 24 in a closed condition. In this closed condition, picture frame assembly 10 can be transported and manipulated without concern that the hinge 24 may open causing the picture frame strut 18 to swing open.

Figure 6:
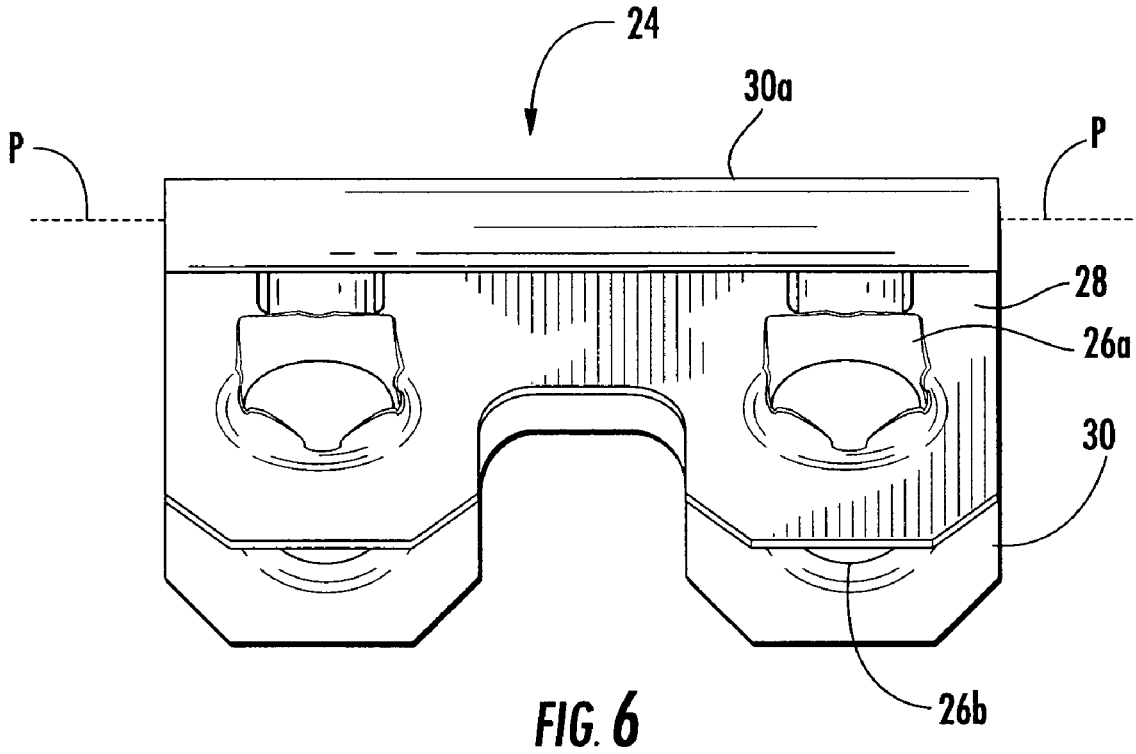
FIG. 6 is a front perspective view of the hinge of FIG. 3 in an open condition.
Figure 7:
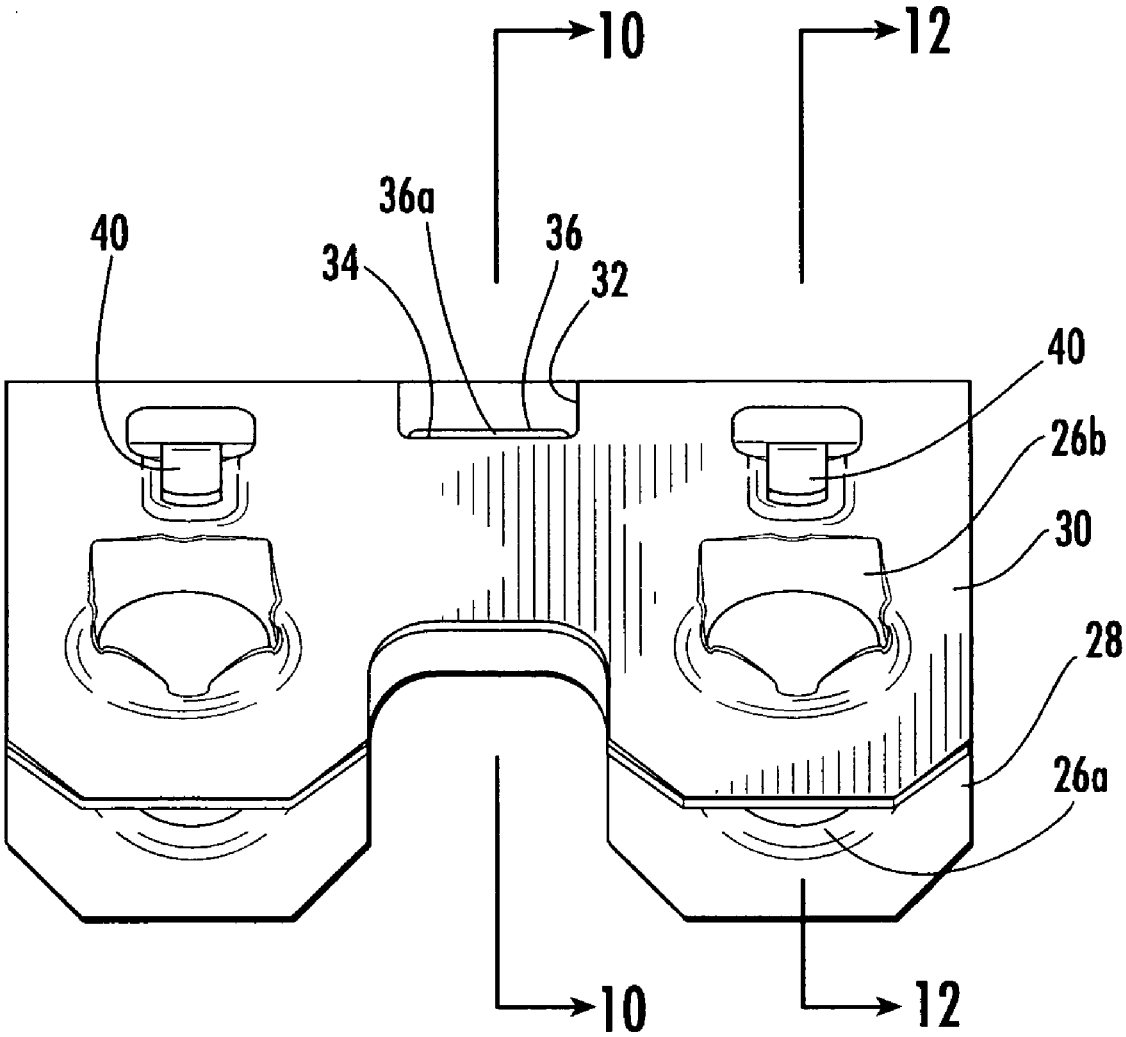
FIG. 7 is a rear perspective view of the hinge of FIG. 3 in an open condition.
Figure 8:
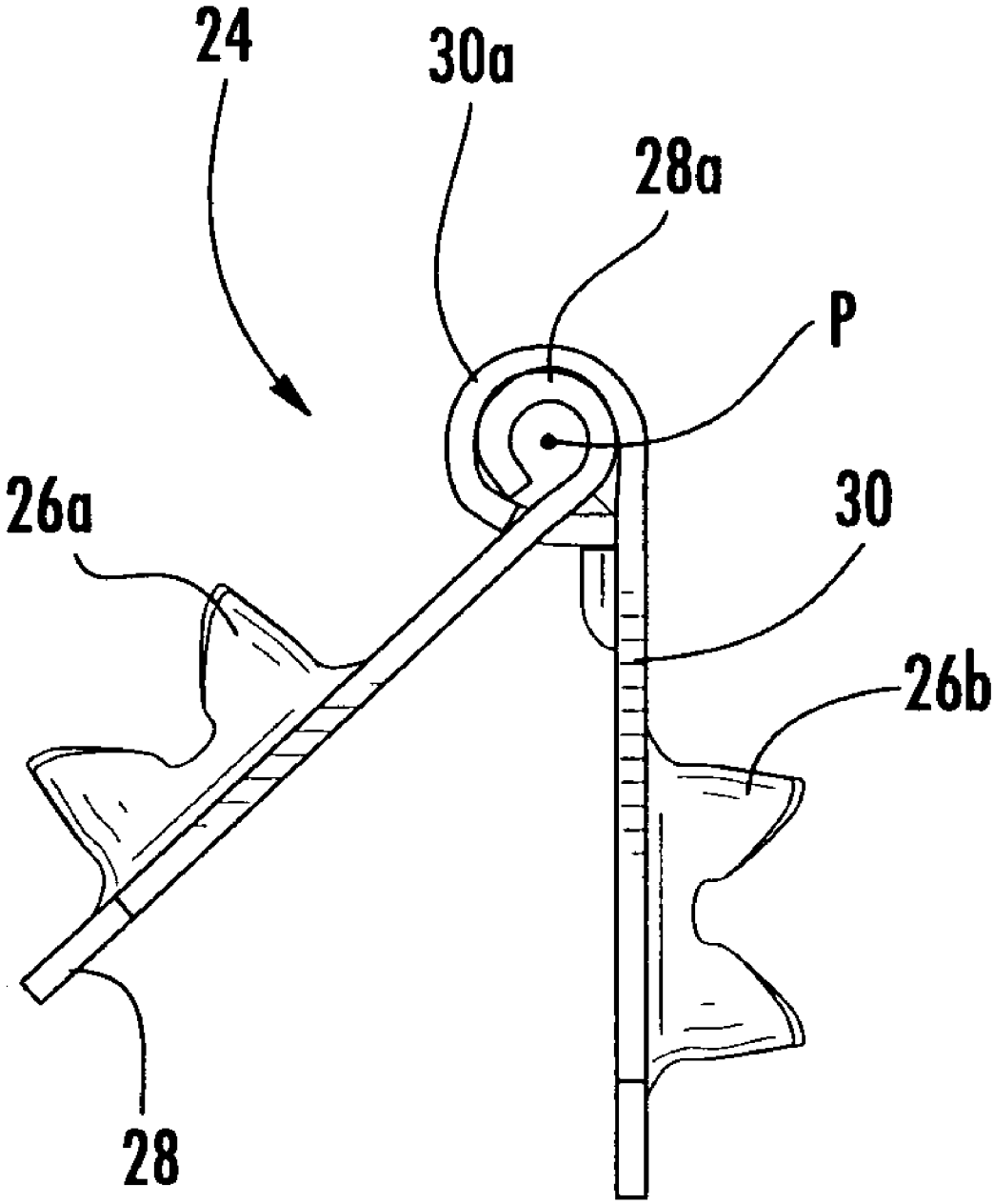
FIG. 8 is a side elevational view of the hinge of FIG. 3 in an open condition.

When it is desired for the strut 18 to be opened so that the picture frame assembly 10 can be propped up on a shelf, or the like, the strut 18 must be swung open. FIGS. 6–8 and 10 illustrate the hinge 24 of the present invention in the open condition. Turning first to FIG. 6, a top perspective view of the hinge 24 in an open condition is shown with its first plate 28 rotatably connected to the second plate 30. FIG. 7 shows a bottom perspective view of the hinge 24 where locking protrusion 36 is no longer fully residing within the window aperture 32 as in FIG. 4 which shows the hinge 24 in a closed condition. In the FIG. 7, the first plate 28 and the second plate 28 have been rotated relative to one another about the pivot axis P. FIG. 8 shows a side elevational view of the open hinge 24 of the present invention.

To open the hinge 24 and lock it in an open condition, the first plate 28 is first rotated angle "C", as seen in FIG. 9, about the pivot axis relative to the second plate 30 so that the side contact surface 36*b* of the protrusion is proximal the edge contact surface 34 of the window aperture 32. In this condition, the hinge 24 is only slightly partially open. This will enable the user to place a finger underneath an attached strut 18 to further pull it away from the picture frame back 20. Further pulling of the strut 18 further opens the hinge 24. The leverage from the strut 18 causes the side contact surface 36*b* of the protrusion 36 to ride over the edge contact surface 34 of the window aperture 32 so that the leading contact surface 36*a* of the protrusion 36 communicates with the side plate surface 30*b* just below the window aperture 32. Since causing the protrusion 36 to ride out of the window aperture 32 requires some force, further friction force will remain to maintain the protrusion 36 in frictional communication with the side plate surface 30*b* on the second plate 30 about the window aperture 32 thereby holding the first plate 28 in an open position relative to the second plate 30. This locked open condition can be seen in FIG. 1B. To close the hinge 24, the strut 18 is pressed toward the picture frame back 20 so that the leading contact surface 36*a* of the protrusion 36 rides off of the side plate surface 30*b* of the second plate 30 into the window aperture 32. This closed locked condition is in FIG. 5, as described in detail above.

The friction force is set to be large enough so that the locking protrusion 36 is frictionally held in place when in an open locked condition and prevented from opening when in a locked closed condition. The friction force is also set to be small enough so that the forces locking the strut 18 can be easily overcome by hand manipulation of the strut 18 attached to the first plate 28. The amount of force required for locking and the relative angles can be modified to suit the application at hand. For example, the friction force can be increased for hinge use in high vibration environments. In a picture frame environments, large forces are not typically required. With these forces, movement from a closed condition to an open condition typically produces an audible click to indicate to the user that the strut 18 has been successfully locked into its new position.

Figure 11:
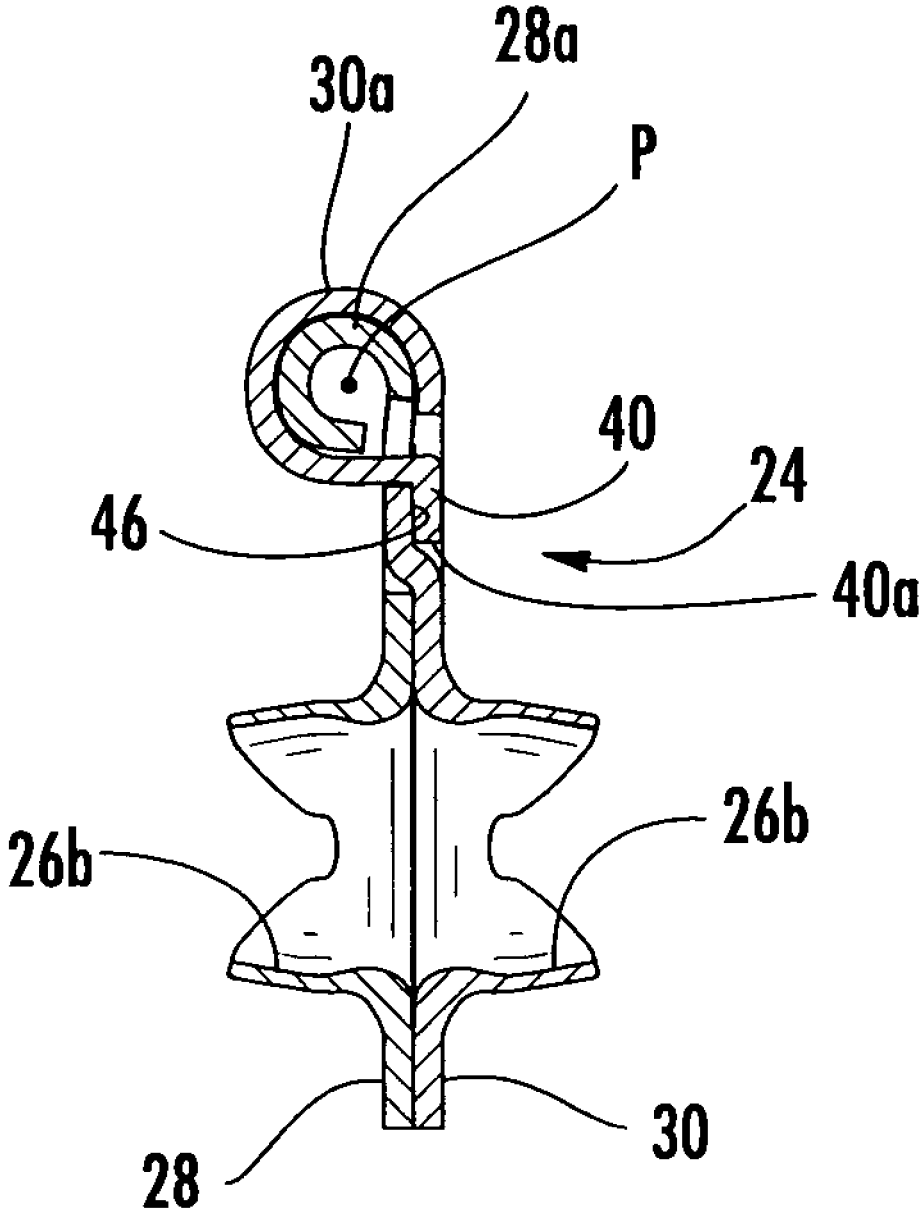
FIG. 11 is a cross-sectional view through the line 11—11 of FIG. 4.
Figure 12:
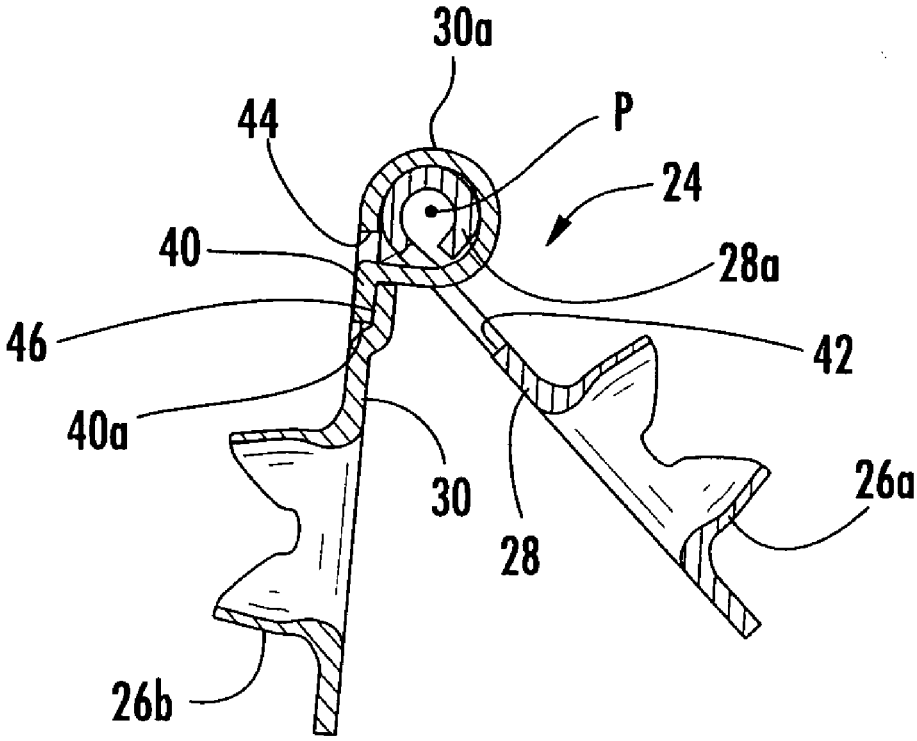
FIG. 12 is a cross-sectional view through the line 12—12 of FIG. 7.

As stated above, the first plate 28 and the second plate 30 can hingedly connected to one another in many different ways. The pinless hinge example of the present invention is further shown in more detail in FIGS. 11 and 12. FIG. 11 shows a cross-sectional view through the line 11—11 of FIG. 4. There is a desire to reduce the weight of hinges. However, thinner stock negatively impacts the integrity of the rolled pivot joint. In this preferred embodiment, locking lugs 40 are used. The top edge 30*a* of the second plate 30 and the top edge 28*a* of the first plate 28 are rolled together. The second plate 30 has locking lug extensions 40 from its top edge 30*a* that pass through respective lug apertures 42 in the first plate 28 and then through lug apertures 44 in the second plate 30. The free ends 42*a* of the locking lug extensions 40 are bent and secured into lug seats 46 on the second plate 30. As result, the rolled top edges 28*a* and 30*a* of the first plate 28 and the second plate 30, respectively, are maintained together. FIG. 12 shows the hinge 24 in an open condition with the locking lugs 40 holding the pinless pivot joint in place.

In view of the foregoing, an improved self-locking hinge is provided that has particular application and use as picture frame hardware. The hinge of the present invention is well-suited to hingedly connect a strut to a picture frame back so the movement thereof can be controlled to a locked open or locked closed positioned. This greatly improves the overall use and enjoyment of a picture frame assembly with a strut that is attached using the hinge of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A self-locking pinless hinge for hingedly connecting a first member to a second member, comprising:

a first plate having length, a width, a top edge and a top surface; the top edge of the first plate have a rolled shape to form a first knuckle;

first fastening means connected to the first plate for affixing the first plate to a first member;

a second plate having a length, a width, a top edge, and a surface; the second plate being rotatably connected to the first plate about a pivot axis, from a substantially closed position to a substanitally open position relative to the first plate; the top edge of the second plate having a rolled shape to form a second knuckle defining a window therein having a free edge and a side plate surface adjacent to the free edge; the first knuckle being radially positioned within the second knuckle;

a second fastening means connected to the second plate for affixing the second to a second member; and locking means connected to the first plate and the second plate for maintaining the second plate in a set position relative to the first plate; the locking means being a protrusion, having a leading contact surface, connected to the first plate that is removably enageable with the side plate surface of second plate to prevent movement of the first plate and the second plate relative to one another as biased by the first knuckle being radially positioned within the second knuckle: the protrusion being freely movable within the window of the second knuckle when the leading contact surface of the protrusion is not in contact with the side contact surface of the second plate.

2. The self-locking hinge of claim 1, wherein the set position is a closed position.

3. The self-locking hinge of claim 1, wherein the set position is an open position.

4. The self-locking hinge of claim 1, wherein the first fastening means and the second fastening means are at least one rosette fastener.

5. The self-locking hinge of claim 1, wherein the first fastening means and the second fastening means are rivets.

6. The self-locking-hinge of claim 1, wherein the first plate, second plate and protrusion are made of metal.

* * * * *